US008816926B2

(12) United States Patent
Yen et al.

(10) Patent No.: US 8,816,926 B2
(45) Date of Patent: Aug. 26, 2014

(54) ANTENNA STRUCTURE

(75) Inventors: Li-Jean Yen, Taipei Hsien (TW); Chia-Tien Li, Taipei Hsien (TW)

(73) Assignee: Wistron NeWeb Corporation, Hsinchu Science Park, Hsinchu (TW)

( * ) Notice: Subject to any disclaimer, the term of this patent is extended or adjusted under 35 U.S.C. 154(b) by 646 days.

(21) Appl. No.: 12/563,171

(22) Filed: Sep. 21, 2009

(65) Prior Publication Data

US 2010/0302105 A1 Dec. 2, 2010

(30) Foreign Application Priority Data

May 27, 2009 (TW) ..... 098209373 U

(51) Int. Cl.
*H01Q 9/04* (2006.01)
*H01Q 5/01* (2006.01)
*H01Q 5/00* (2006.01)
*H01Q 1/24* (2006.01)

(52) U.S. Cl.
CPC ..... *H01Q 9/0421* (2013.01); *H01Q 9/0414* (2013.01); *H01Q 5/0055* (2013.01); *H01Q 1/243* (2013.01)
USPC ..... 343/828; 343/702; 343/829

(58) Field of Classification Search
USPC ..... 343/700 MS, 702, 826, 828, 846, 848, 343/829
See application file for complete search history.

(56) References Cited

U.S. PATENT DOCUMENTS

| | | | | |
|---|---|---|---|---|
| 6,982,675 | B2 * | 1/2006 | Kwak et al. | 343/702 |
| 6,985,114 | B2 * | 1/2006 | Egashira | 343/702 |
| 7,119,747 | B2 * | 10/2006 | Lin et al. | 343/702 |
| 7,136,025 | B2 * | 11/2006 | Lin et al. | 343/770 |
| 7,289,071 | B2 * | 10/2007 | Hung et al. | 343/702 |
| 7,345,634 | B2 * | 3/2008 | Ozkar et al. | 343/702 |
| 7,446,717 | B2 * | 11/2008 | Hung et al. | 343/702 |
| 7,498,992 | B2 * | 3/2009 | Hung et al. | 343/702 |
| 2007/0040750 | A1 * | 2/2007 | Tai et al. | 343/700 MS |

* cited by examiner

*Primary Examiner* — Michael C Wimer
(74) *Attorney, Agent, or Firm* — Winston Hsu; Scott Margo

(57) ABSTRACT

An antenna structure has a first resonance mode and a second resonance mode. The antenna structure consists of a first radiation element, a second radiation element, a grounding element, and a signal feeding element. The first radiation element resonates at a first operating frequency band corresponding to the first resonance mode. The second radiation element is extended from a first end of the first radiation element and resonates at a second operating frequency band corresponding to the second resonance mode. The grounding element is extended from a second end of the first radiation element. The signal feeding element is disposed between the first radiation element and the grounding element. The second radiation element, the first radiation element, and the grounding element are formed by bending a slender metal sheet.

21 Claims, 8 Drawing Sheets

ANTENNA STRUCTURE

BACKGROUND OF THE INVENTION

1. Field of the Invention

The present invention relates to an antenna structure, and more particularly, to a folded multi-band antenna capable of improving impedance matching and adjusting its operating frequency bands.

2. Description of the Prior Art

As wireless telecommunication develops with the trend of micro-sized mobile communication products, the location and the space arranged for antennas are limited. Therefore, some built-in micro antennas have been developed. Currently, micro antennas such as chip antennas, planar antennas etc are commonly used. All these antennas have the feature of small volume. Additionally, planar antennas are also designed in many types such as microstrip antennas, printed antennas and planar inverted F antennas (PIFA). These antennas are widespread applied to GSM, DCS, UMTS, WLAN, Bluetooth, etc.

Please refer to FIG. 1. FIG. 1 is a diagram of a conventional planar inverted F antenna (PIFA) 100 according to the prior art. The PIFA 100 consists of a radiation element 110, a grounding element 120, and two conductive pins 130 and 140. The conductive pin 130 is coupled to the grounding element 120 to be used as a grounding point, and the conductive pin 140 passes through the grounding element 120 and is further coupled to a wireless transceiver circuit (not shown) to be used as a signal feeding point. In this way, when the conductive pin 140 feeds a current into the radiation element 110, the current is divided into two current paths I1 and I2. Path lengths of these two current paths I1 and I2 are different from each other, wherein the path length of the first current path I1 is approximately one-fourth of a wavelength ($\lambda/4$) of a first resonance mode generated by the planar inverted F antenna 100 and the path length of the second current path I2 is approximately one-fourth of a wavelength of a second resonance mode generated by the planar inverted F antenna 100. In other words, the conventional PIFA 100 is capable of transmitting/receiving electromagnetic waves of two different frequencies.

Since the radiation element 110 of the conventional PIFA 100 is a rectangular-shaped plane, it occupies a large area, which is inconsistent with market demands of thin and light volume. In addition, as the conductive pins 130 and 140 are disposed between the radiation element 110 and the grounding element 120, its size and location are fixed. Accordingly, it is difficult to adjust impedance matching and operating frequency band of the conventional PIFA 100 depending on design requirements.

SUMMARY OF THE INVENTION

It is one of the objectives of the present invention to provide an antenna structure capable of improving impedance matching and adjusting operating frequency bands to solve the above-mentioned problems.

The present invention discloses an antenna structure. The antenna has at least a first resonance mode and a second resonance mode. The antenna structure consists of a first radiation element, a second radiation element, a grounding element, and a signal feeding element. The first radiation element resonates at a first operating frequency band corresponding to the first resonance mode. The second radiation element is extended from a first end of the first radiation element and resonates at a second operating frequency band corresponding to the second resonance mode. The grounding element is extended from a second end of the first radiation element. The signal feeding element is disposed between the first radiation element and the grounding element. The second radiation element, the first radiation element, and the grounding element are an all-in-all design and are formed by bending a slender metal sheet.

The present invention further discloses an antenna structure. The antenna structure consists of a first radiation element, a second radiation element, a grounding element, a parasitic element, and a signal feeding element. The second radiation element is extended from a first end of the first radiation element, and the grounding element is extended from a second end of the first radiation element. The parasitic element is extended from the grounding element and disposed between the first radiation element and the grounding element for forming coupling effects between the first radiation element and the parasitic element. The signal feeding element is disposed between the first radiation element and the parasitic element.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
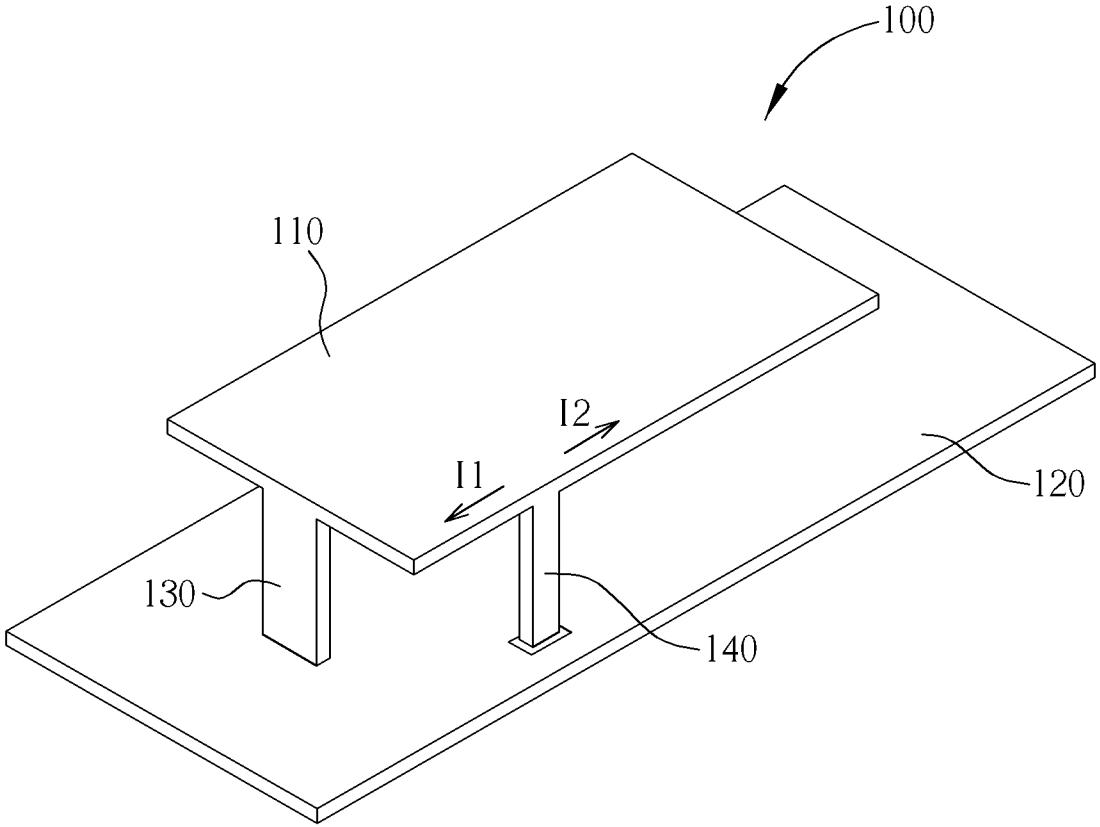
FIG. 1 PRIOR ART
FIG. 1 is a diagram of a conventional PIFA according to the prior art.
Figure 2:
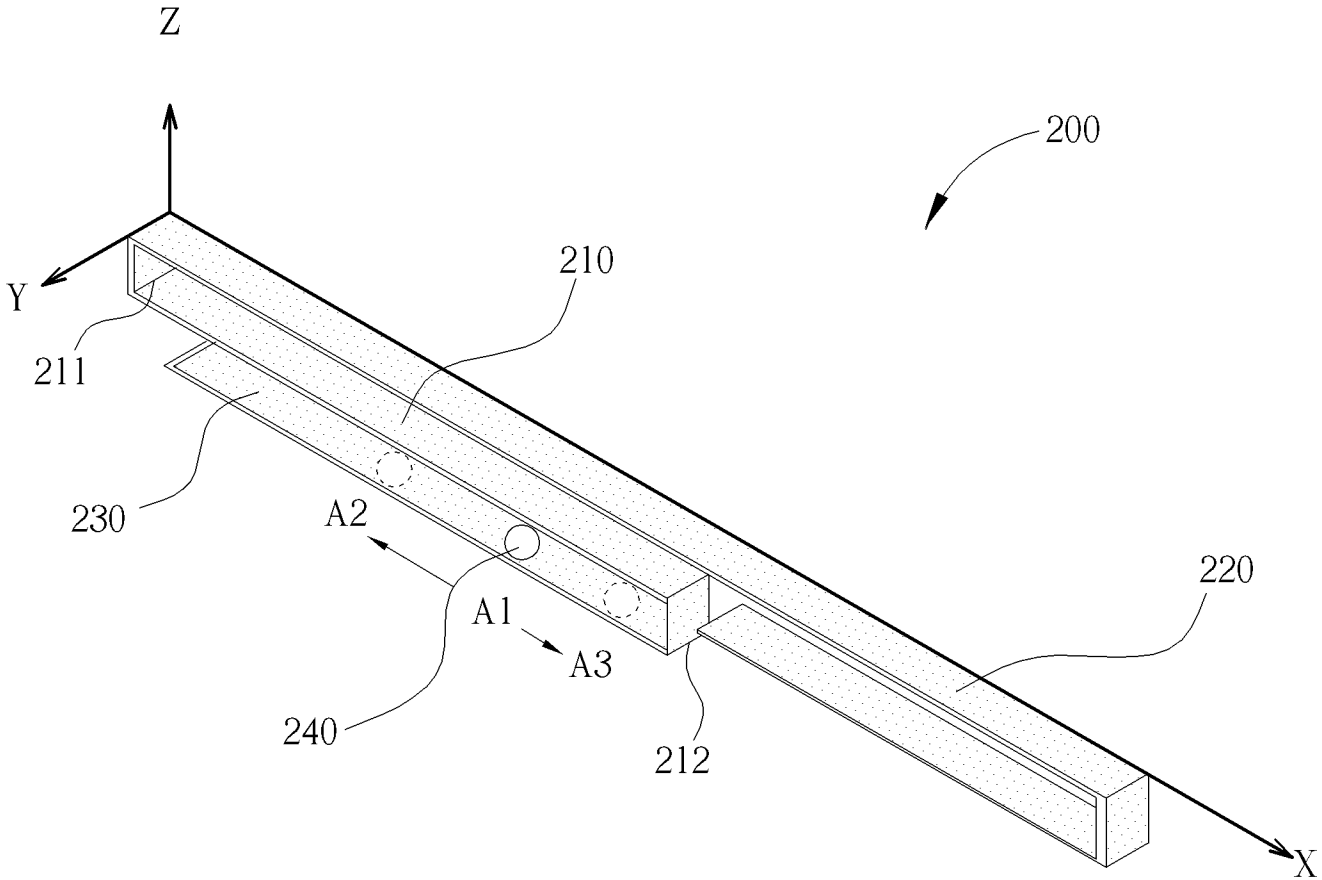
FIG. 2 is a three-dimensional figure of an antenna structure according to a first embodiment of the present invention.

Please refer to FIG. 2. FIG. 2 is a three-dimensional figure of an antenna structure 200 according to a first embodiment of the present invention. As shown in FIG. 2, the antenna structure 200 consists of a first radiation element 210, a second radiation element 220, a grounding element 230, and a signal feeding element 240. Be noted that the second radiation element 220 is extended from a first end 211 of the first radiation element 210, and the grounding element 230 is extended from a second end 212 of the first radiation element 210. The signal feeding element 240 is disposed between the first radiation element 210 and the grounding element 230. In this embodiment, the second radiation element 220, the first radiation element 210, and the grounding element 230 are an all-in-one design and are formed by bending a slender metal sheet. The first radiation element 210 includes at least one bend, and the second radiation element 220 includes at least one bend.

Figure 3:
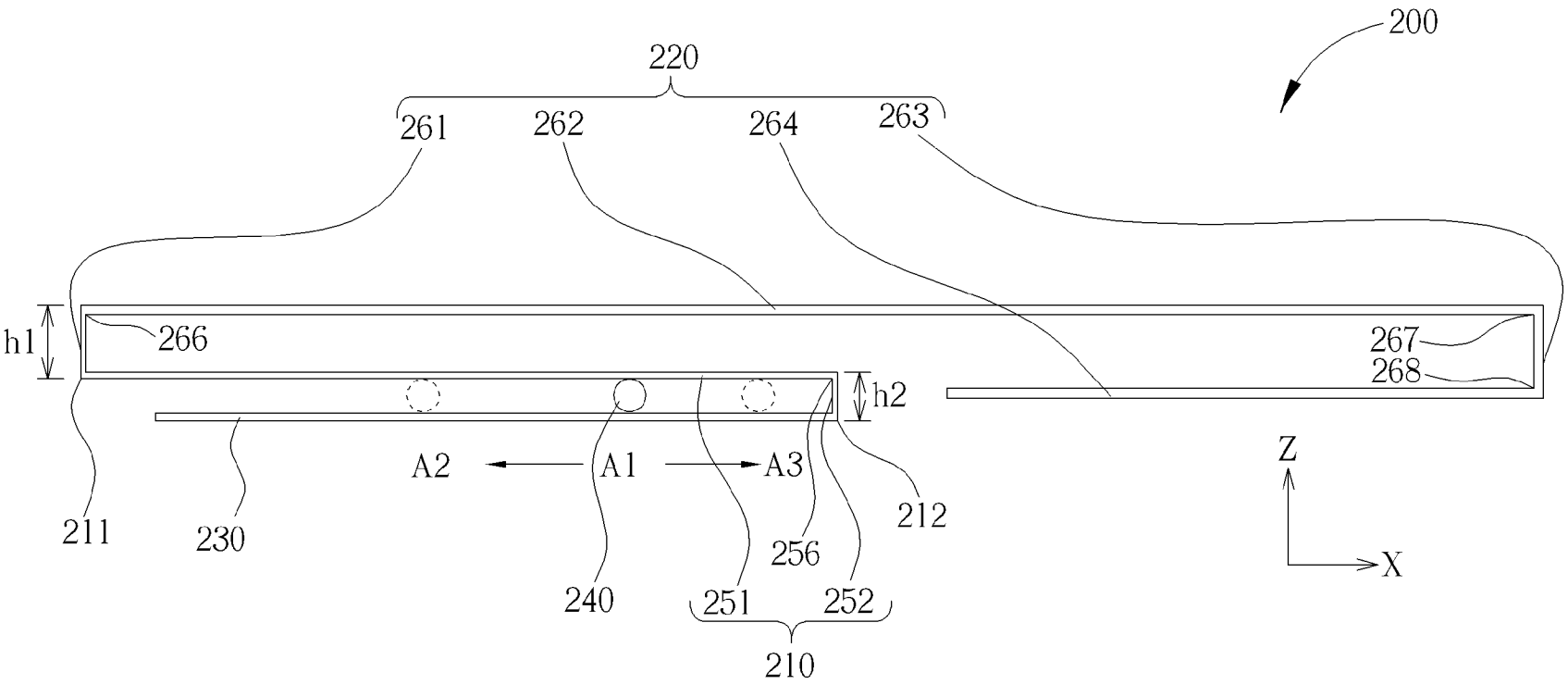
FIG. 3 is a side sectional view of the antenna structure shown in FIG. 2.

Please refer to FIG. 3. FIG. 3 is a side sectional view of the antenna structure 200 shown in FIG. 2. As shown in FIG. 3, the first radiation element 210 consists of a plurality of sections 251 and 252, wherein the sections 251 and 252 form at least one bend 256. The second radiation element 220, extended from the first end 211 of the first radiation element 210, consists of a plurality of sections 261, 262, 263, and 264, wherein the sections 261, 262, 263, and 264 form at least one bend 266, 267, and 268. The antenna structure 200 can be folded by bending it with different bending directions, so as to reduce its antenna size. In this embodiment, the section 251 of the first radiation element 210 substantially parallels and at least partially overlaps the section 262 of the second radiation element 220 in a first designated direction (i.e. the X axis), and the section 251 of the first radiation element 210 substantially parallels and least partially overlaps the grounding element 230 in the first designated direction (i.e. The X axis). Perfectly, the section 262 of the second radiation element 220 has a segment completely overlaps the section 251 of the first radiation element 210 in the first designated direction. In addition, the section 251 of the first radiation element 210 is at a first designated distance h1 from the section 262 of the second radiation element 220 in a second designated direction (i.e. the Z axis), and the section 251 of the first radiation element 210 is at a second designated distance h2 from the grounding element 230 in the second designated direction (i.e. the Z axis), wherein a ratio of the first designated distance h1 to the second designated distance h2 is in between 1:1 and 1:20. For example, the first designated distance h1 can be designed as 1.0 ~3.0 mm, while the second designated distance h2 can be designed as 3.0~20.0 mm.

In this embodiment, the antenna structure 200 has at least a first resonance mode and a second resonance mode. The first radiation element 210 resonates at a first operating frequency band (i.e. a higher frequency) corresponding to the first resonance mode, and a length of the first radiation element 210 (including the sections 251 and 252) is approximately one-fourth of a wavelength ($\lambda/4$) of the first resonance mode. The second radiation element 220 resonates at a second operating frequency band (i.e. a lower frequency) corresponding to the second resonance mode, and a length of the second radiation element 220 (including the sections 261, 262, 263, and 264) is approximately one-fourth of a wavelength of the second resonance mode. In other words, the antenna structure 200 is a multi-band antenna (a dual-band antenna) and can be disposed in a housing of a wireless communication device, such as a portable device or an ultra-mobile personal computer (UMPC). But the present invention is not limited to this only and it can be applied to wireless communication devices of other types.

Please note that, in this embodiment, both the first end 211 and the second end 212 of the first radiation element 210 are located at the bending locations. But this is presented merely to illustrate practicable designs of the present invention, the first end 211 and the second end 212 of the first radiation element 210 are not limited to be disposed at the bending locations. In addition, the signal feeding element 240 is coupled between the section 251 of the first radiation element 210 and the grounding element 230. In this embodiment, the signal feeding element 240 is disposed in a location A1. Be noted that the location of the signal feeding element 240 is not unchangeable and can be moved to anywhere between locations A2 and A3 according to the arrow indicated in FIG. 2 (or FIG. 3).

Figure 4:
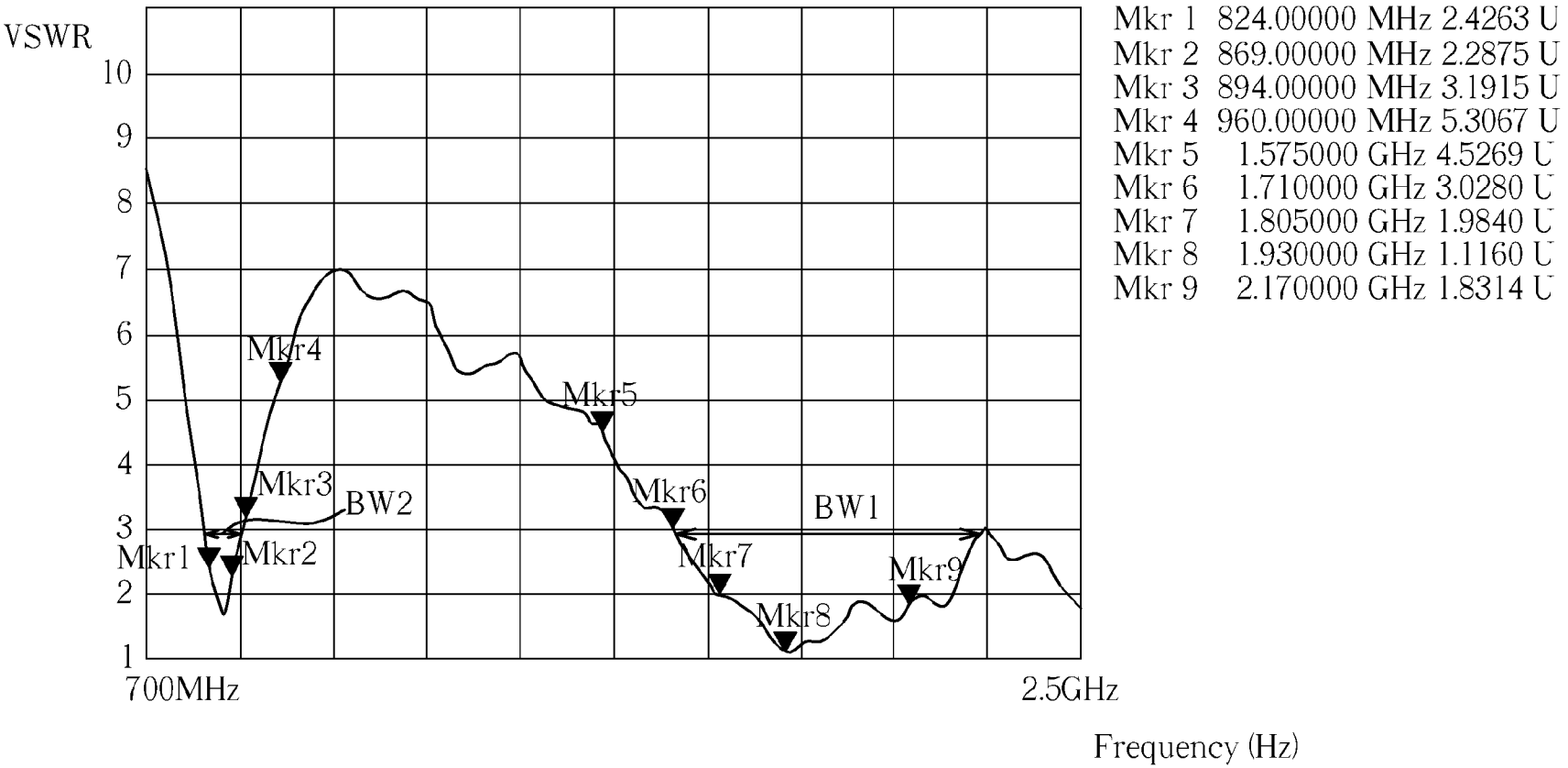
FIG. 4 is a diagram illustrating the VSWR of the antenna structure shown in FIG. 2.

Please refer to FIG. 4. FIG. 4 is a diagram illustrating the VSWR of the antenna structure 200 shown in FIG. 2. The horizontal axis represents frequency (Hz), between 700 MHz and 2.5 GHz, and the vertical axis represents the VSWR. As shown in FIG. 4, a center frequency of the second operating frequency band BW2 of the antenna structure 200 is 840 MHz, which has a bandwidth ratio of 9.5%; and a center frequency of the first operating frequency band BW1 of the antenna structure 200 is 1955 MHz, which has a bandwidth ratio of 25%. Therefore, operational demands for 3G wireless mobile communications can be satisfied. Moreover, the impedance matching and operating frequency bands (such as BW1 and BW2) of the antenna structure 200 can be adjusted by changing the aforementioned designated distances h1 and h2.

Certainly, the antenna structure 200 shown in FIG. 2 is merely an embodiment of the present invention, and those skilled in the art should appreciate that various modifications of the antenna structure 200 shown in FIG. 2 may be made without departing from the spirit of the present invention. For example, the number of the bends of the first radiation element 210 and the second radiation element 220 is not limited. In addition, the bending direction, the bending angle, and the bending shape of each bend should not be considered to be limitations of the scope of the present invention.

Figure 5:
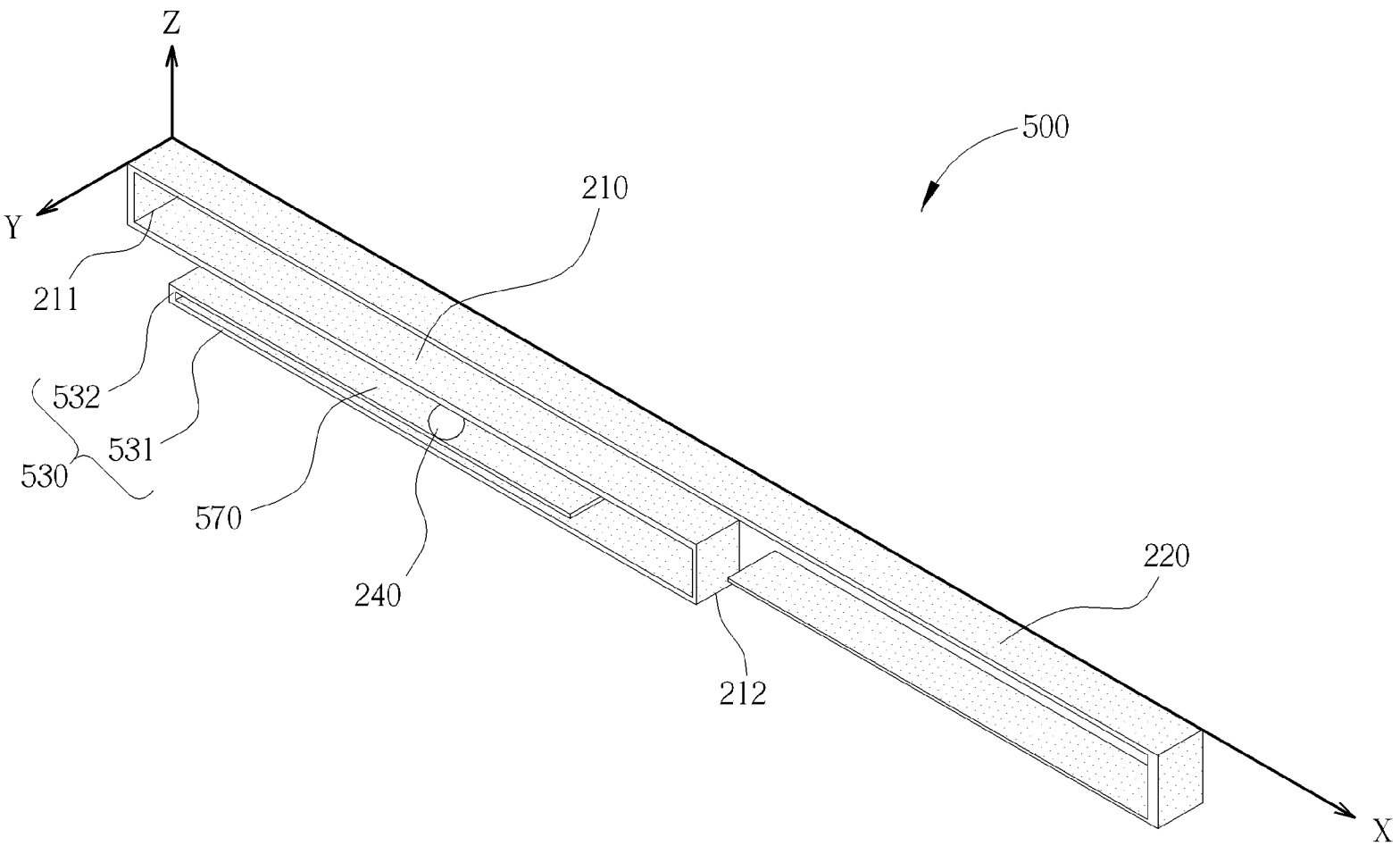
FIG. 5 is a three-dimensional figure of an antenna structure according to a second embodiment of the present invention.

Please refer to FIG. 5. FIG. 5 is a three-dimensional figure of an antenna structure 500 according to a second embodiment of the present invention, which is a varied embodiment of the antenna structure 200 shown in FIG. 2. In FIG. FIG. 5, the architecture of the antenna structure 500 is similar to that of the antenna structure 200 shown in FIG. 2, and the difference between them is that the antenna structure 500 further includes a parasitic element 570 extended from the grounding element 530 for forming coupling effects between the first radiation element 210 and the parasitic element 570. The signal feeding element 240 is coupled between the first radiation element 210 and the parasitic element 570. In this embodiment, the second radiation element 220, the first radiation element 210, the grounding element 530, and the parasitic element 570 are an all-in-one design and are formed by bending a slender metal sheet, but the present invention is not limited to this only. Herein the first radiation element 210 has at least one bend, the second radiation element 220 (extended from the first end 211 of the first radiation element 210) has at least one bend, and the grounding element 530 (extended from the second end 212 of the first radiation element 210 and including sections 531 and 532) also has at least one bend.

Figure 6:
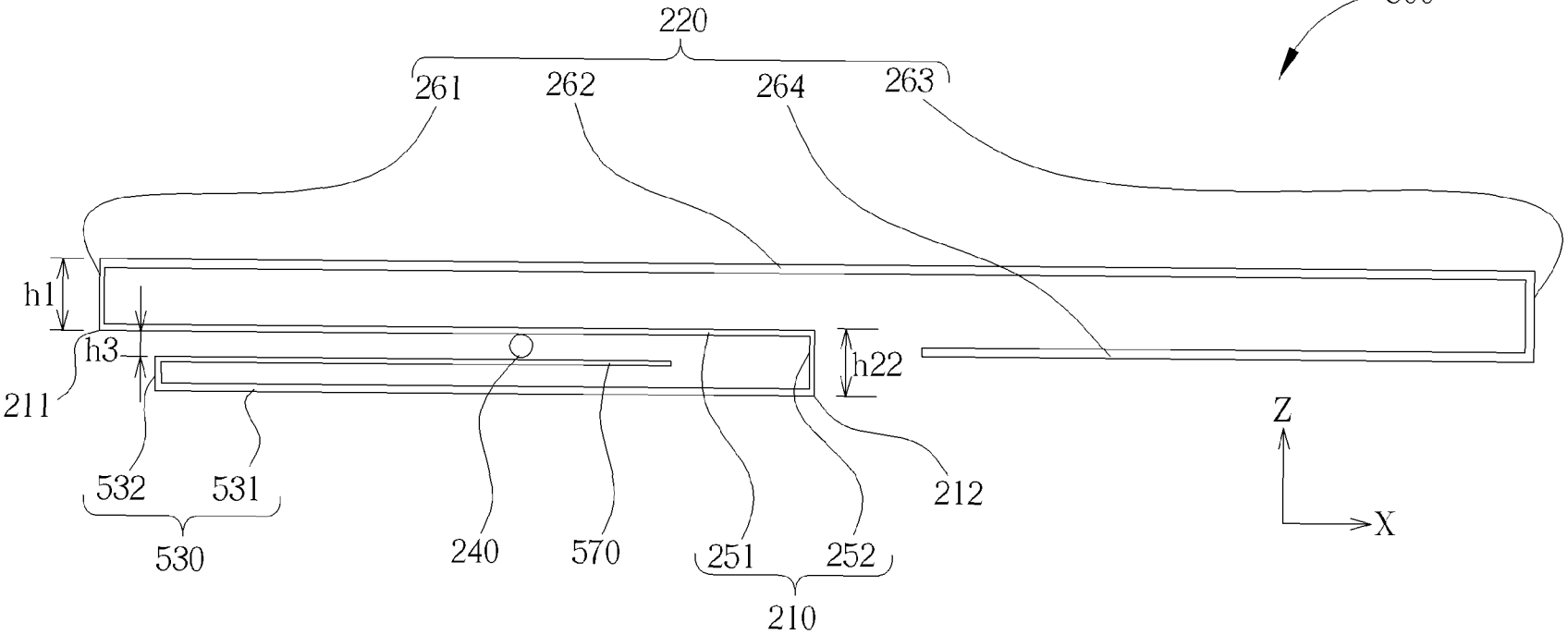
FIG. 6 is a side sectional view of the antenna structure shown in FIG. 5.

Please refer to FIG. 6. FIG. 6 is a side sectional view of the antenna structure 500 shown in FIG. 5. As shown in FIG. 6, the section 251 of the first radiation element 210 substantially parallels and at least partially overlaps the section 262 of the second radiation element 220 in the first designated direction (i.e. the X axis), and the section 251 of the first radiation element 210 substantially parallels and least partially overlaps the parasitic element 570 in the first designated direction (i.e. The X axis). Perfectly, the section 251 of the first radiation element 210 has a segment completely overlaps the parasitic element 570 in the first designated direction. In addition, the section 251 of the first radiation element 210 is at the first designated distance h1 from the section 262 of the second radiation element 220 in the second designated direction (i.e. the Z axis), and the section 251 of the first radiation element 210 is at a second designated distance h22 from the section 531 of the grounding element 530 in the second designated direction (i.e. the Z axis), the section 251 of the first radiation element 210 is at a third designated distance h3 from the parasitic element 570 in the second designated direction (i.e. the Z axis), wherein a ratio of the first designated distance h1 to the second designated distance h22 is in between 1:1 and 1:20. For example, the first designated distance h1 can be designed as 1.0~3.0 mm, while the second designated distance h22 can be designed as 3.0~20.0 mm.

Since the section 251 of the first radiation element 251 substantially parallels and at least partially (or completely)

overlaps the parasitic element 570 in the first designated direction (i.e. the X axis), the parasitic element 570 forms coupling effects between the first radiation element 210 and the parasitic element 570 so as to adjust the bandwidths of the first operating frequency band and the second operating frequency band. Be noted that the aforementioned designated distances h1, h22, and h3 are related to the operating frequency bands of the antenna structure 500, the impedance matching of the first radiation element 210 and the second radiation element 220 can be improved and the bandwidths of the antenna structure 500 can be increased by adjusting the designated distances h1, h22, and h3.

Figure 7:
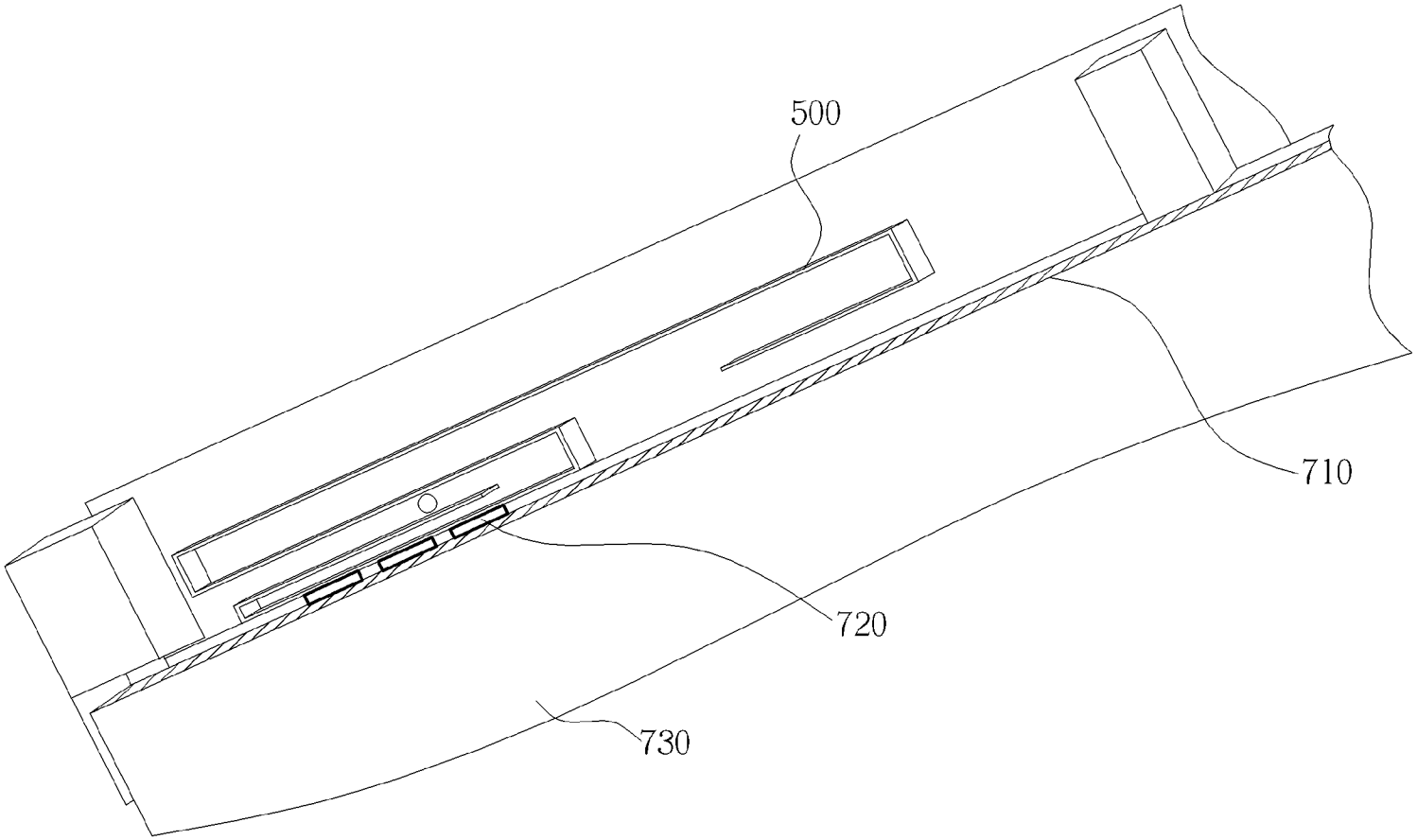
FIG. 7 is a diagram illustrating the antenna structure of FIG. 5 assembled in a wireless communication product.

Please refer to FIG. 7. FIG. 7 is a diagram illustrating the antenna structure 500 of FIG. 5 assembled in a wireless communication product. As shown in FIG. 7, the antenna structure 500 is disposed on the top of a panel 730 of the wireless communication product. Herein 710 represents a metal wall, and insulation spacers 720 are disposed between the metal wall 710 and the antenna structure 500 in order to make a portion of the grounding element 530 shown in FIG. 5 contact with the insulation spacers 720 and another portion of grounding element 530 contact with the metal wall 710. However, the location and the area of the insulation spacers 720 shown in FIG. 7 should not be considered to be limitations of the scope of the present invention, and can be adjusted depending on actual demands. The antenna efficiency of the antenna structure 500 can be adjusted by changing the location and the area of the insulation spacers 720.

Figure 8:
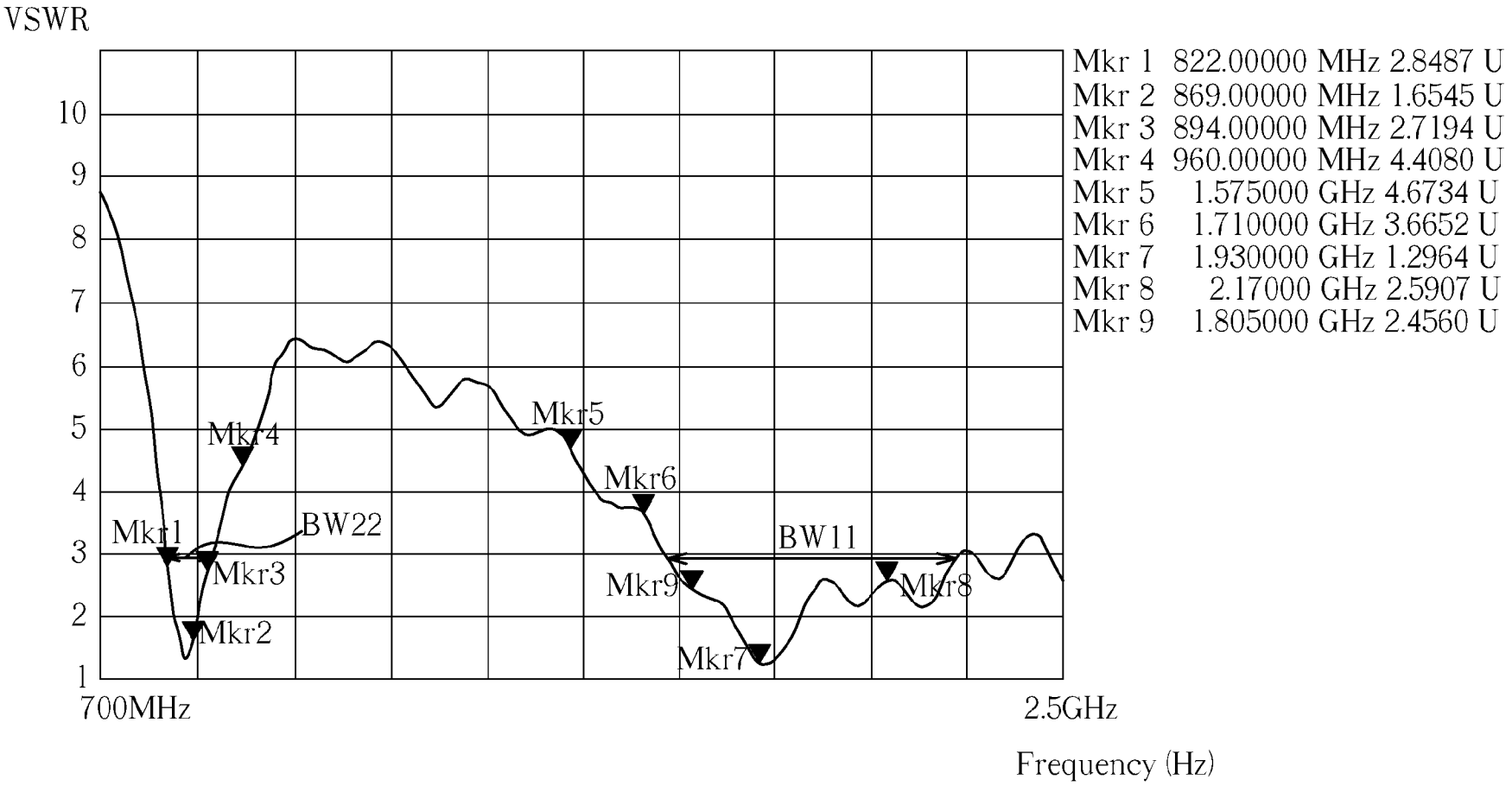
FIG. 8 is a diagram illustrating the VSWR of the antenna structure shown in FIG. 5.

Please refer to FIG. 8. FIG. 8 is a diagram illustrating the VSWR of the antenna structure 500 shown in FIG. 5. The horizontal axis represents frequency (Hz), between 700 MHz and 2.5 GHz, and the vertical axis represents the VSWR. As shown in FIG. 8, a center frequency of the second operating frequency band BW22 of the antenna structure 500 is 860 MHz, which has a bandwidth ratio of 10%; and a center frequency of the first operating frequency band BW11 of the antenna structure 500 is 2086 MHz, which has a bandwidth ratio of 31%. Therefore, operational demands for 3G wireless mobile communications can be satisfied. As can be seen by comparing FIG. 8 with FIG. 4, the impedance matching of the first radiation element 210 and the second radiation element 220 can be improved and the bandwidth of the antenna structure 500 can be widened by adding the parasitic element 570 extended from the grounding element 530 into the antenna structure 500.

Undoubtedly, those skilled in the art should appreciate that various modifications of the antenna structures shown in FIG. 2-FIG. 5 may be made without departing from the spirit of the present invention. In addition, the number of the bends is not limited, and the bending direction, the bending angle, and the bending shape of each bend should not be considered to be limitations of the scope of the present invention.

The abovementioned embodiments are presented merely to illustrate features of the present invention, and in no way should be considered to be limitations of the scope of the present invention. From the above descriptions, the present invention provides an antenna structure being an all-in-one design and formed by bending a slender metal sheet, which can be folded by bending it with different bending directions so as to reduce the antenna size. In other words, the antenna structure disclosed in the present invention can come into being a multi-band antenna (a dual-band antenna) by bending a slender metal sheet. In addition, its antenna height can be effectively decreased in order to reduce the antenna size and achieve an optimum antenna performance. Moreover, a parasitic element extended from the grounding element can be further added into the antenna structure in order to form coupling effects between the first radiation element and the parasitic element. Therefore, by adjusting the aforementioned designated distances h1, h2, h22, and h3, the impedance matching of the first radiation element and the second radiation element can be improved and the bandwidths of the antenna structure can be increased. Additionally, it is easy to manufacture the antenna structure disclosed in the present invention to effectively control the size and the cost of the antenna, which is suitable for wireless communication products with embedded antennas.

Those skilled in the art will readily observe that numerous modifications and alterations of the device and method may be made while retaining the teachings of the invention.

What is claimed is:

1. An antenna structure, having at least a first resonance mode and a second resonance mode, the antenna structure comprising:

a first radiation element, for resonating at a first operating frequency band corresponding to the first resonance mode;

a second radiation element, extended from a first end of the first radiation element, for resonating at a second operating frequency band corresponding to the second resonance mode;

a grounding element, extended from a second end of the first radiation element; and a signal feeding element, disposed between the first radiation element and the grounding element;

wherein each of a first section of the first radiation element, a second section of the second radiation element, and a third section of the grounding element substantially parallels and at least partially overlaps with the others in an X axis; and, the second end of the first radiation element is an opposite end of the first radiation element compared to the first end of the first radiation element in the X axis; the second radiation element includes a section which is parallel to the second section of the second radiation element and substantially in a same plane as the first section of the first radiation element.

2. The antenna structure of claim 1, wherein the second radiation element, the first radiation element, and the grounding element are an all-in-one design and are formed by bending a slender metal sheet.

3. The antenna structure of claim 2, wherein the first radiation element comprises at least one bend, and the second radiation element comprises at least one bend.

4. The antenna structure of claim 1, wherein the signal feeding element is coupled between the first radiation element and the grounding element.

5. The antenna structure of claim 1, wherein a length of the first radiation element is approximately one-fourth of a wavelength ($\lambda/4$) of the first resonance mode generated by the antenna structure; and a length of the second radiation element is approximately one-fourth of a wavelength of the second resonance mode generated by the antenna structure.

6. The antenna structure of claim 1, wherein the first section of the first radiation element substantially paralleling and at least partially overlapping the second section of the second radiation element in the X axis.

7. The antenna structure of claim 6, wherein the second section of the second radiation element comprises a segment completely overlapping the first section of the first radiation element in the X axis.

8. The antenna structure of claim 6, wherein the first section of the first radiation element substantially parallels and at least partially overlaps a third section of the grounding element in the X axis; the first section of the first radiation element is at a first designated distance from the second section of the second radiation element in a second designated direction; the first section of the first radiation element is at a second designated distance from the third section of the grounding element in the second designated direction; and a ratio of the first designated distance to the second designated distance is in between 1:1 and 1:20.

9. The antenna structure of claim 1, further comprising:

a parasitic element, extended from the grounding element, for forming coupling effects between the first radiation element and the parasitic element.

10. The antenna structure of claim 9, wherein the signal feeding element is coupled between the first radiation element and the parasitic element.

11. The antenna structure of claim 9, wherein the first section of the first radiation element substantially paralleling and at least partially overlapping the second section of the second radiation element in the X axis; and the first section of the first radiation element substantially parallels and at least partially overlaps the parasitic element in the X axis.

12. The antenna structure of claim 11, wherein the first section of the first radiation element comprises a segment completely overlapping the parasitic element in the X axis.

13. The antenna structure of claim 11, wherein the first section of the first radiation element substantially parallels and at least partially overlaps the third section of the grounding element in the X axis; the first section of the first radiation element is at a first designated distance from the second section of the second radiation element in a second designated direction; the first section of the first radiation element is at a second designated distance from the third section of the grounding element in the second designated direction; and a ratio of the first designated distance to the second designated distance is in between 1:1 and 1:20.

14. An antenna structure, comprising:

a first radiation element;

a second radiation element, extended from a first end of the first radiation element;

a grounding element, extended from a second end of the first radiation element;

a parasitic element, extended from the grounding element and disposed between the first radiation element and the grounding element, for forming coupling effects between the first radiation element and the parasitic element; and a signal feeding element, disposed between the first radiation element and the parasitic element;

wherein each of a first section of the first radiation element, a second section of the second radiation element, and a third section of the grounding element substantially parallels and at least partially overlaps with the others in an X axis; and, the second end of the first radiation element is an opposite end of the first radiation element compared to the first end of the first radiation element in the X axis; the second radiation element includes a section which is parallel to the second section of the second radiation element and substantially in a same plane as the first section of the first radiation element.

15. The antenna structure of claim 14, wherein the second radiation element, the first radiation element, the grounding element, and the parasitic element are an all-in-one design and are formed by bending a slender metal sheet.

16. The antenna structure of claim 15, wherein the first radiation element comprises at least one bend, and the second radiation element comprises at least one bend.

17. The antenna structure of claim 14, wherein a length of the first radiation element is approximately one-fourth of a wavelength ($\lambda/4$) of a first resonance mode generated by the antenna structure; and a length of the second radiation element is approximately one-fourth of a wavelength of a second resonance mode generated by the antenna structure.

18. The antenna structure of claim 14, wherein the signal feeding element is coupled between the first radiation element and the parasitic element.

19. The antenna structure of claim 14, wherein the first section of the first radiation element substantially paralleling and at least partially overlapping the second section of the second radiation element in the X axis; and the first section of the first radiation element substantially parallels and at least partially overlaps the parasitic element in the X axis.

20. The antenna structure of claim 19, wherein the first section of the first radiation element comprises a segment completely overlapping the parasitic element in the X axis.

21. The antenna structure of claim 19, wherein the first section of the first radiation element substantially parallels and at least partially overlaps the third section of the grounding element in the X axis; the first section of the first radiation element is at a first designated distance from the second section of the second radiation element in a second designated direction; the first section of the first radiation element is at a second designated distance from the third section of the grounding element in the second designated direction; and a ratio of the first designated distance to the second designated distance is in between 1:1 and 1:20.

* * * * *